United States Patent [19]

Harada et al.

[11] Patent Number: 4,689,027

[45] Date of Patent: Aug. 25, 1987

[54] TRANSMISSION MECHANISM FOR A MARINE OUTBOARD DRIVE

[75] Inventors: Norimichi Harada; Akihiro Onoue, both of Hamamatsu, Japan

[73] Assignee: Sanshin Kogyo Kabushiki Kaisha, Hamamatsu, Japan

[21] Appl. No.: 819,743

[22] Filed: Jan. 16, 1986

[30] Foreign Application Priority Data

Jan. 31, 1985 [JP] Japan ..... 60-15414

[51] Int. Cl.[4] ..... B63H 21/28

[52] U.S. Cl. ..... 440/75; 440/83

[58] Field of Search ..... 440/75, 78, 83, 86, 440/900

[56] References Cited

U.S. PATENT DOCUMENTS 1,511,868 10/1924 Asbury ..... 440/78
2,973,738 3/1961 Ladewig ..... 440/75
3,937,093 2/1976 Johnson et al. ..... 440/78
4,302,196 11/1981 Blanchard ..... 440/75

*Primary Examiner*—Joseph F. Peters, Jr.
*Assistant Examiner*—Stephen P. Avila
*Attorney, Agent, or Firm*—Ernest A. Beutler

[57] ABSTRACT

A marine outboard drive and more particularly to an improved transmission and propeller shaft supporting arrangement for the lower unit. The propeller shaft is supported by means of a spaced anti-friction bearings to avoid cantilever loading of the propeller shaft. In addition, the propeller shaft has a splined connection with an intermediate shaft of a forward, neutral, reverse transmission and this splined connection includes internal splines formed in an enlarged diameter portion of the propeller shaft. One of the spaced anti-friction bearings engages the enlarged diameter portion of the propeller shaft.

11 Claims, 4 Drawing Figures

Fig-1
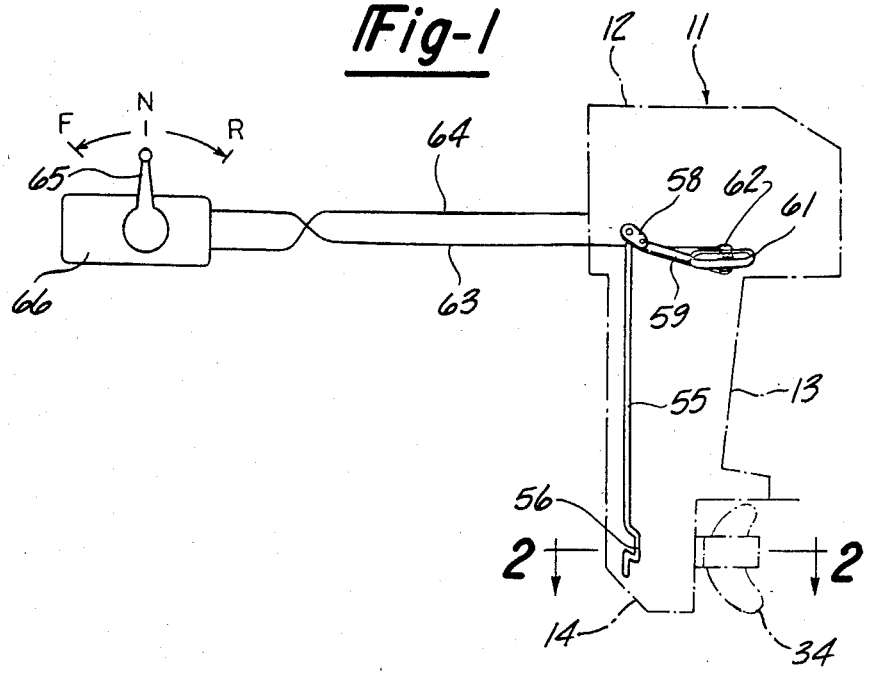
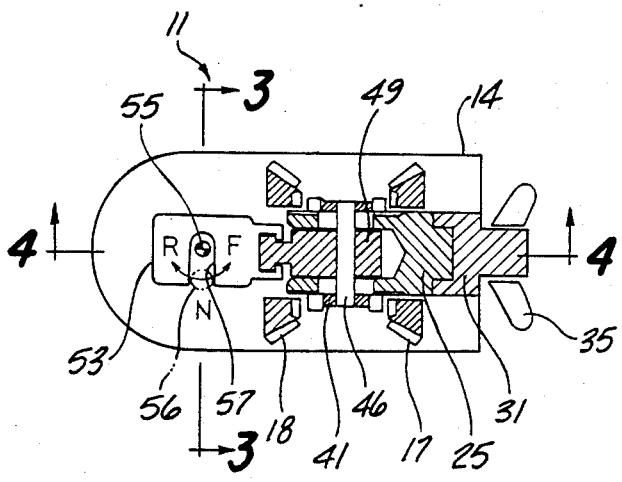
Fig-2
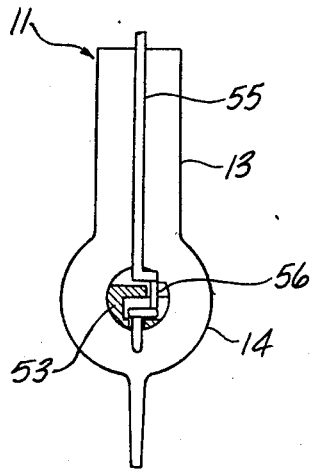
Fig-3

TRANSMISSION MECHANISM FOR A MARINE OUTBOARD DRIVE

BACKGROUND OF THE INVENTION

This invention relates to a transmission mechanism for a marine outboard drive and more particularly to an improved supporting and driving arrangement for the propeller shaft of such a drive.

As is well known most marine outboard drives, be they the lower unit of an outboard motor or the lower unit of the outboard drive portion of an inboard/outboard drive assembly, have a drive shaft and propeller shaft that extend at right angles to each other. Some form of driving mechanism, normally a forward, neutral, reverse transmission interconnect the drive shaft and the propeller shaft for driving the propeller shaft. The rear end of the propeller shaft extends through an opening in the rear face of the lower unit and a propeller is affixed to the extending end of the propeller shaft. With such arrangements, the rear or trailing end of the propeller shaft is supported by means of an anti-friction bearing. However, the inner end of the propeller shaft is not normally directly supported by an anti-friction bearing and, hence, the propeller shaft is cantilevered about the rearwardly positioned bearing. Such cantilevered support for the propeller shafts can cause wear and other problems in connection with the transmission of power.

It is, therefore, a principal object of this invention to provide an improved bearing arrangement for the propeller shaft of a marine outboard drive.

It is a further object of this invention to provide a bearing arrangement for a marine drive propeller shaft wherein the propeller shaft is supported by spaced apart bearings so as to avoid cantilever loading and twisting forces.

In marine outboard drive transmissions, it is frequently necessary or desirable to provide a splined connection between the propeller shaft and a further driving shaft of the transmission. When such a splined connection is employed, good support should be provided for the splined portions of the shaft so as to insure against bending loads, as might be resultant if a cantilevered construction is provided. In addition, it is desirable to provide the splined connection in such a way that a relatively large and robust bearing may be provided.

It is, therefore, a further object of this invention to provide an improved bearing arrangement for a splined propeller shaft drive of a marine outboard unit.

SUMMARY OF THE INVENTION

A first feature of this invention is adapted to be embodied in a final drive arrangement for a marine outboard drive comprising a lower unit housing, a drive shaft journaled for rotation relative to the lower unit housing, a propeller shaft contained at least in part in the lower unit housing and means for driving the propeller shaft from the drive shaft. In accordance with this feature of the invention, first and second spaced anti-friction bearing means are provided for directly rotatably journaling the propeller shaft.

Another feature of the invention is also adapted to be embodied in a final drive arrangement for a marine outboard drive of the type described generally in the preceding paragraph. In accordance with this feature of the invention, there is provided an intermediate shaft that is driven by the drive shaft and which drives the propeller through a splined connection. The splined connection is formed by a male splined portion of the intermediate shaft and a corresponding female splined portion of the propeller shaft. The female splined portion is supported directly within the lower unit housing by an anti-friction bearing that is juxtaposed to the splined connection.

BRIEF DESCRIPTION OF THE DRAWINGS

FIG. 1 is a partially schematic side elevational view of an outboard motor and transmission control constructed in accordance with an embodiment of the invention.

FIG. 2 is an enlarged cross-sectional view taken generally along the line 2—2 of FIG. 1.

FIG. 3 is a cross-sectional view taken along the line 3—3 of FIG. 2.

DETAILED DESCRIPTION OF THE PREFERRED EMBODIMENT

Figure 4:
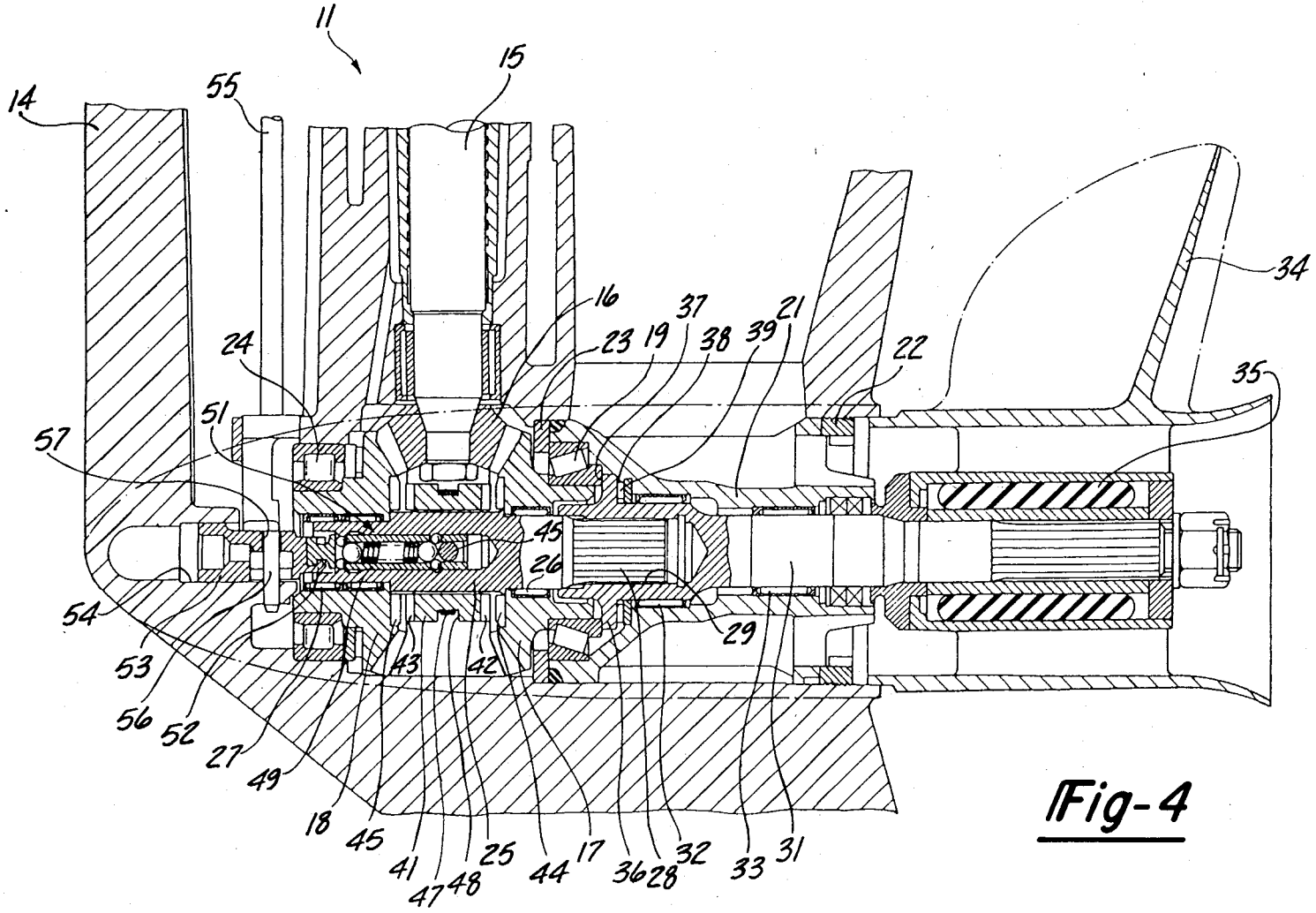
FIG. 4 is a further enlarged cross-sectional view taken along the line 4—4 of FIG. 2.

Referring first to FIG. 1, an outboard motor constructed in accordance with an embodiment of the invention is identified generally by the reference numeral 11 and is shown primarily in phantom. Although the invention is described in conjunction with an outboard motor, the invention relates to the final drive unit and specifically the lower unit and, accordingly, the invention may be practiced equally as well with the outboard drive unit of an inboard/outboard arrangement. The outboard motor 11 is particularly adapted for use as one of the two units of a twin outboard drive. The motor 11 is particularly adapted for use as the additional motor wherein the input or drive shaft rotates in the same direction as a conventional motor but wherein the propeller shaft rotates in an opposite direction and has a propeller that is of an opposite hand so as to balance the driving thrust.

The outboard motor 11 includes a power head 12 including an internal combustion engine and a surrounding protective cowling. The engine of the power head 12 drives a vertically disposed drive shaft (to be described) that extends through a drive shaft housing 13 and terminates within a lower unit 14. Contained within the lower unit 14 is a transmission mechanism which will now be described by particular reference to FIGS. 2 through 4.

The engine driven drive shaft previously referred to is identified by the reference numeral 15 and has a driving bevel gear 16 affixed to its lower end for simultaneous rotation with the drive shaft 15. A pair of driven bevel gears 17 and 18 are in mesh with diametrically opposite sides of the driving bevel gear 16 so that the driven gears 17 and 18 will rotate in opposite directions upon rotation of the driving gear 16.

The driven bevel gear 17 has its hub portion rotatably journaled by means of a tapered roller thrust bearing 19 which is, in turn, carried in a bearing carrier 21. The bearing carrier 21 is held in position within an internal cavity of the lower unit housing 14 by means including a retaining nut 22. The opposite end of the thrust bearing 19 and specifically its outer race is engaged with a thrust stop 23 that is affixed between the bearing carrier 21 and the housing of the lower unit 14.

The driven bevel gear 18 has its hub portion journaled in the housing of the lower unit 14 by means of a roller bearing assembly 24. The driven gears 17 and 18, in turn, rotatably journal an intermediate shaft 25 by means of axially spaced needle bearings 26 and 27, respectively. The intermediate shaft 25 has a splined rear end 28 which is received within an internally splined opening 29 formed in an enlarged portion of a propeller shaft 31. The propeller shaft 31 is journaled within the bearing carrier 21 by means of a pair of axially spaced needle bearings 32 and 33. Because of the use of the two axially spaced bearing assemblies 32 and 33, the propeller shaft 31 will be rigidly held and not in a cantilevered manner as with certain prior art constructions. In addition, the needle bearing 32 engages the larger diameter portion of the propeller shaft 31 that is formed with the internal splines 29 so as to provide a good load bearing capability.

A propeller 34 is affixed to the exposed rear end of the propeller shaft 31 by means of a torsionally resilient coupling 35. The normal direction of rotation of the propeller shaft 31 for forward motion is the opposite as that of a conventional outboard motor because of the fact that the motor 11 is designed as the added non-conventional unit of a twin outboard drive. For that reason, the propeller 34 has an opposite hand to that of the conventional propellers. In order to drive the propeller shaft 31 in such a counter direction, the gear 17 functions as the forward drive gear while in a conventional outboard drive, the drive gear 18 comprises the forward drive gear. Since the gear 17 is the forward drive gear, some arrangement should be provided so as to insure that the driving thrusts do not increase the pressure between the gears 17 and 16 and cause undue wear. The splined connection 28 serves to assist in insuring that the forward driving thrusts will not be exerted upon the gear 17.

The propeller shaft 31 is provided with an annular thrust collar 36 which is integrally formed with the enlarged diameter portion and generally centrally of the internal splines 29. The thrust collar 36 has a forwardly facing thrust surface 37 that is engaged with the inner race of the thrust bearing 19 so that forward driving thrusts are transmitted from the propeller shaft 31 through the face 37 to the inner race of the bearing 19 and from the bearing 19 through the thrust sleeve 23 to the housing of lower unit 14. In a similar manner, the thrust flange 36 is formed with a rearwardly facing surface 38 that is engaged with a needle type thrust bearing 39 which, in turn, is engaged with the bearing housing 21 so as to transfer reverse driving thrusts to the housing of the lower unit 14 through the thrust bearing 39 and bearing housing 21. Thus, the forward and reverse thrusts are taken by two different bearings and these bearings may each be sized to accommodate the respective loads. The thrusts are also independently transmitted to the housing of the lowr unit 14. It should be noted that the forward driving thrusts are greater and, hence, the thrust bearing 19 is larger than the thrust bearing 39. In addition and as has been noted, the bearing 19 serves to rotatably journal the driven gear 17 and the intermediate shaft 25.

The method for drivingly coupling either of the gears 17 or 18 selectively for rotation with the intermediate shaft 25, propeller shaft 31 and propeller 34 includes a dog clutching sleeve 41 that has a splined connection to the central portion of the intermediate shaft 25. By virtue of this splined connection, the dog clutching sleeve 41 may move axially relative to the intermediate shaft 25 but is rotatably affixed to it. The sleeve 41 has oppositely facing dog clutching teeth 42 and 43 that are adapted to engage and mesh with corresponding clutching teeth 44 and 45 on the driven gears 17 and 18, respectively.

The mechanism for shifting the clutching sleeve 41 from the neutral position shown in FIGS. 2 and 4 to the engaged position with either the gears 17 or 18 includes a pin 46 that extends diametrically through the shaft 25 and into the sleeve 41. The pin 46 is held axially in position by means of a torsional spring 47 that is received within a circumferential groove 48 in the sleeve 41. The pin 46 extends through axially extending diametrically opposed slots formed in the intermediate shaft 25 so as to permit its axial movement relative to the intermediate shaft 25 while being held against rotation relative to the shaft 25.

The pin 46 is staked to one end of a shifting sleeve 49 that is slidably supported within a bore of the intermediate shaft 25. A detent mechanism, indicated generally by the reference numeral 51 and having a construction as described in copending application Ser. No. 503,570, filed June 13, 1983, entitled "Detent Mechanism For Clutches", and assigned to the same assignee of this application, is provided for holding the dog clutching sleeve 41 and shifting sleeve 49 in the neutral position and for assisting in the movement of the dog clutching sleeve 41 into engagement as described in that copending application which is incorporated herein by reference.

A tongue and groove connection 52 connects the forward end of the shifting sleeve 49 to a shifting cam assembly 53. The cam assembly 53 is supported for reciprocation within a bore 54 of the housing of the lower unit 14. The tongue and groove connection 52 permits rotation of the shifting sleeve 49 relative to the shifting cam 53 while coupling these two elements together for simultaneous axial movement.

A shift rod 55 extends vertically through the drive shaft housing and has a crank shaped portion 56 at its lower end. The crank shaped portion 56 is received in a slot 57 in the cam 53 so that rotation of the shifting rod 55 will cause reciprocation of the shifting cam 53 and, accordingly, of the shifting sleeve 49 and dog clutching sleeve 41 to engage either the gear 17 or the gear 18 for rotation with the intermediate shaft 25 and the propeller shaft 31.

A link 58 is affixed to the upper end of the shifting rod 55 and is, in turn, connected to a second link 59 which carries a cam groove 61 at its outer end. An actuator element 62 is received in the cam groove 61 and is connected to a pair of flexible transmitters 63 and 64. The flexible transmitters 63 and 64 are connected at their forward end to a shift lever 65 of a shift control mechanism 66 that is positioned within the associated watercraft in proximity to the operator. The shift lever 65 is shiftable from the neutral position as shown in FIG. 1 in a forward direction to the forward transmission ratio selecting position. During such forward movement, the shifting rod 55 rotates in a counterclockwise direction so as to urge the shifting cam 53 and shifting sleeve 49 rearwardly so that the dog clutch teeth 42 engage the dog clutching teeth 44 and forward drive is selected. Movement of the shift lever 65 in the rearward direction accomplishes forward movement of the shifting cam 53 and the dog clutching teeth 43 will engage the dog clutching teeth 45 and select reverse gear of the transmission.

It should be readily apparent from the foregoing description that an extremely effective and robust support is provided for the propeller shaft wherein all driving forces are taken through substantial bearing arrangements so as to minimize wear. Although an embodiment of the invention has been illustrated in particularly combination with an outboard motor, as has been noted that this invention can be utilized with the lower unit of the outboard portion of an inboard/outboard drive or in other marine applications. Various other changes and modifications may be made without departing from the spirit and scope of the invention, as defined by the appended claims.

We claim:

1. In a final drive arrangement for a marine outboard drive comprising a lower unit housing, a drive shaft journaled for rotation relative to said lower unit housing, a propeller shaft contained at least in part in said lower unit housing, and means for driving said propeller shaft from said drive shaft including a forward, reverse transmission, the improvement comprising thrust bearing means for taking thrust loadings on said propeller shaft in opposite axial directions and separate, first and second spaced anti-friction bearing means for directly engaging said propeller shaft and providing direct radial support therefor for rotatably journaling said propeller shaft.

2. In a final drive arrangement as set forth in claim 1 wherein the first and second anti-friction bearing means are carried by a bearing carrier detachably supported within the lower unit housing.

3. In a final drive arrangement as set forth in claim 1 wherein the propeller shaft has a portion that extends rearwardly through a rear opening in the lower unit and one of the anti-friction bearing means is juxtaposed to said opening.

4. In a final drive arrangement as set forth in claim 3 wherein the means for driving the propeller shaft from the drive shaft comprises a pair of intermeshing bevel gears.

5. In a final drive arrangement as set forth in claim 4, wherein there is a driving bevel gear affixed to the drive shaft and a pair of counter-rotating bevel gears associated with the propeller shaft and further including dog clutching means for selectively coupling one of said driven bevel gears for rotation with said propeller shaft for forming the forward, reverse transmission.

6. In a final drive arrangement as set forth in claim 5 wherein the first and second anti-friction bearing means are carried by a bearing carrier detachably supported within the lower unit housing.

7. In a final drive arrangement as set forth in claim 5 further including an intermediate shaft rotatably journaling the driven bevel gears and having a splined connection with the propeller shaft.

8. In a final drive arrangement as set forth in claim 7 wherein the splined connection of the propeller shaft with the intermediate shaft comprises internal splines on the propeller shaft formed in an enlarged diameter portion of said propeller shaft, one of said anti-friction bearing means being engaged with said enlarged diameter portion of said propeller shaft.

9. A final drive arrangement for a marine outboard drive comprising a lower unit housing, a drive shaft journaled for rotation relative to said lower unit housing, a propeller shaft contained at least in part in said lower unit housing, an intermediate shaft having a splined connection with said propeller shaft for driving said propeller shaft from said intermediate shaft and means for driving said intermediate shaft from said drive shaft, the improvement comprising the splined connection between said intermediate shaft and said propeller shaft comprising internal splines formed in said propeller shaft and external splines formed in said intermediate shaft, and anti-friction bearing means directly supporting said propeller shaft for rotation in an area axially aligned with said internal splines.

10. A final drive arrangement as set forth in claim 9 wherein the means for driving the intermediate shaft from the drive shaft comprises a pair of intermeshing bevel gears.

11. A final drive arrangement as set forth in claim 10 wherein there is a driving bevel gear affixed to the drive shaft and a pair of counter-rotating bevel gears associated with the intermediate shaft and further including dog clutching means for selectively coupling one of said driven bevel gears for rotation with said intermediate shaft.

* * * * *